United States Patent [19]

Wagner et al.

[11] Patent Number: 4,703,642

[45] Date of Patent: Nov. 3, 1987

[54] PROCESS AND DEVICE FOR MANUFACTURING A SECTION, IN PARTICULAR A HOLLOW SECTION, VIA EXTRUSION

[75] Inventors: Alfred Wagner, Steisslingen; Ulf Hodel, Engen; Adolf Ames, Hilzingen, all of Fed. Rep. of Germany

[73] Assignee: Swiss Aluminium Ltd., Chippis, Switzerland

[21] Appl. No.: 914,231

[22] Filed: Oct. 2, 1986

Related U.S. Application Data

[63] Continuation-in-part of Ser. No. 693,346, Jan. 22, 1985, abandoned.

[30] Foreign Application Priority Data

Jan. 24, 1984 [DE] Fed. Rep. of Germany ..... 3402300

[51] Int. Cl.[4] ..... B21C 25/02; B21C 25/04; B21C 27/00; B21C 23/04

[52] U.S. Cl. ..... 72/259; 72/269; 72/272

[58] Field of Search ..... 72/253.1, 259, 260, 72/269, 272, 467

[56] References Cited

U.S. PATENT DOCUMENTS

| | | | |
|---|---|---|---|
| 89,326 | 4/1869 | Merrie | 72/258 |
| 814,731 | 3/1906 | Robertson | 72/259 |
| 2,991,877 | 7/1961 | Knapp et al. | 72/259 |
| 3,347,079 | 10/1967 | Rowell | 72/259 |
| 3,394,579 | 7/1968 | Hall et al. | 72/269 |
| 3,527,079 | 9/1970 | Braeuninger | 72/269 |
| 3,786,665 | 1/1974 | Creuzet | 72/269 |
| 4,159,560 | 7/1979 | Wagner | 72/272 |
| 4,169,366 | 10/1979 | Ames | 72/467 |
| 4,277,968 | 7/1981 | Pardoe | 72/262 |

FOREIGN PATENT DOCUMENTS

| | | | |
|---|---|---|---|
| 346647 | 4/1931 | United Kingdom | 72/259 |
| 584922 | 12/1977 | U.S.S.R. | 72/269 |

*Primary Examiner*—Lowell A. Larson
*Attorney, Agent, or Firm*—Bachman & LaPointe

[57] ABSTRACT

A process and device for manufacturing a section, in particular a hollow section, especially from light metal billets. To this end a plurality of billets is simultaneously forced through the shape-giving cross-section of a die and united to form the matrix metal for the section. For this purpose at least two bores in the container are aligned with the shape-giving cross-section of the die.

4 Claims, 5 Drawing Figures

X
32

10
15
V
V
15
32
31
A
5
28
4
M
5
31

PROCESS AND DEVICE FOR MANUFACTURING A SECTION, IN PARTICULAR A HOLLOW SECTION, VIA EXTRUSION

CROSS-REFERENCE TO RELATED APPLICATIONS

This application is a Continuation-In-Part of U.S. patent application Ser. No. 693,346, filed Jan. 22, 1985, now abandoned.

BACKGROUND OF THE INVENTION

The invention relatmes to a process and device for manufacturing a section, in particular a hollow section, especially from light metal billets, via extrusion in which billets residing in a container are introduced as matrix metal by an extrusion stem into the shape-giving cross-section of a die.

Flat, broad sections are normally extruded from so called rectangular containers having a rounded elongated cross-sectional bore housing a billet of the same shape. A container of this kind with liner enclosed in an outer sleeve is described for example in German Pat. No. 24 17 815.

When extruding light metal the width and height of the container bore are given by the limitation that the ratio of extrusion bore to the cross-sectional area should be larger than 400N/mm$^2$ and the width about 2.5 times the height. The actual dimensional limits are given by the minimum specific force required to extrude light metal sections.

Some of the disadvantages of such rectangular containers compared with round versions are the higher costs incurred when manufacturing the dummy block, extrusion stem and container bore. Furthermore, as a result of the geometry of the sleeve, elevated stresses arise at the middle of the narrow sides where longitudinal cracks and thus failure of the container can occur, especially when extruding sections of elongated cross-section.

One method for overcoming the problem of longitudinal cracks in rectangular containers is disclosed in U.S. Pat. No. 4,007,619 by Adolf Ames and Alfred Wagner, assigned to the Assignee of the instant invention. In accordance with the '619 patent stresses are reduced in the corners of the narrow sides of the rectangular container by providing an elastic welding material which expands during the pressure stroke of the extruding device so as to aid in reducing cracks. While the foregoing systems offers some advantages over previously known systems, problems still arose in the weld area. Naturally it would be highly desirable to provide a mechanism for extruding wide rectangular hollow sections which does not suffer from the above known disadvantages.

In view of the above, the object of the invention is to enable the manufacture of larger, especially broader extrusion sections without the problems of the conventional rectangular containers, and in addition to increase the possible dimensions of such sections further.

SUMMARY OF THE INVENTION

The foregoing object is achieved by way of the invention in that simultaneously a plurality of billets is pressed through a common shape-giving cross-section of the die and is united to form the matrix for the section and thus the section itself.

In the case of an elongated extrusion cross-section the section should, according to the invention, be extruded from plurality of billets on a common axis, in the case of a hollow section via conventional mandrels.

Within the scope of the invention is a device of the above mentioned kind, with at least two bores in the container aligned with the shape-giving cross-section for one section.

The bores in the container are preferably of conventional round cross-section. The distance between the bores is, according to the invention, small and such that more than two bores should lie on that common and preferably horizontal axis. In the case of an extrusion cross-section resembling a sinusoidal line the billets are not arranged in a straight line but at an extremely small distance from a straight line which also preferably runs horizontal.

By providing a plurality of container bores in the manner of the instant invention in order to produce the wide hollow sections, the stresses at the corner of the bores are greatly reduced over those devices heretofore known and eliminate the problem of cracking due to stress concentrations.

Instead of the usual rectangular container therefore use is made of a container with a plurality of bores in it housing the same number of billets to manufacture a single section; the centers of the bores in the container are to particular advantage arranged on a common horizontal axis.

Diameter and number of bores are selected such that a given specific pressure for a desired product range is achieved.

An extrusion stem is as normal arranged, in terms of the extrusion direction, upstream in front of each bore, and such that according to the invention all the extrusion stems for the one single shape-giving cross-section are mounted on a common main stem.

According to a further feature of the invention between each bore and the shape-giving die opening is a plurality of inlet openings which are preferably symmetrically arranged.

The described manner of producing a section of larger cross-sectional length by direct extrusion of a plurality of billets is not limited to the hollow sections in the following description of the figures; it is henceforth also possible to produce other sections of elongated cross-section in one piece, for example vehicle side and tailboards which up to now have been made up of several individual sections.

Extremely broad sections, in particular so called flat hollow sections for road and rail bound vehicles have up to now normally been made using rectangular containers and porthole dies. Rectangular containers suffer the disadvantage of a limited service life as the concentration of bending and compressive stresses at the narrow side frequently lead to premature failure of the liner.

With the process according to the invention a part of the role of the porthole die vis., the division of the billet into separate streams around the mandrels, is extended back to the container. To achieve this one requires a container with a plurality of round bores arranged side-by-side and a corresponding number of individual extrusion stems on a common main stem. Utilizing this concept it is possible to manufacture with the same specific pressure sections which are about 70% broader than can be made with conventional rectangular containers.

BRIEF DESCRIPTION OF THE DRAWINGS

Further advantages, features and details of the invention are revealed in the following description of preferred exemplified embodiments and with the aid of the schematic drawings viz.

DETAILED DESCRIPTION

Figure 1:
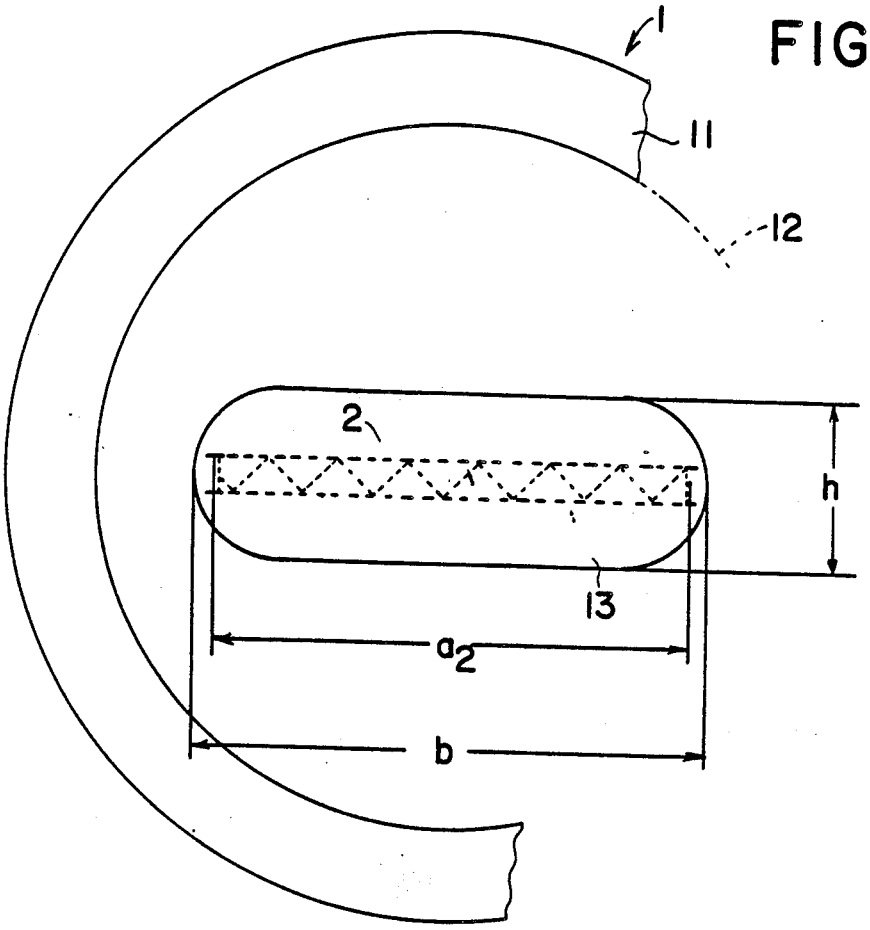
FIG. 1: Is an end view of a rectangular container for the production of an elongated hollow section.

A conventional rectangular container of an extrusion press, which for reasons of space is omitted in FIG. 1, features in an inner liner 12 surrounded by a shrink-fit ring 1 a container bore 13 of width b equal to 750 mm and height h of 250 mm. This bore 13, in spite of its somewhat rounded cross-section, is called rectangular and accepts a light metal ingot or billet of corresponding cross-section for the manufacture of a hollow section 2 of breadth $a_2$ which here is 700 mm.

Figure 2:
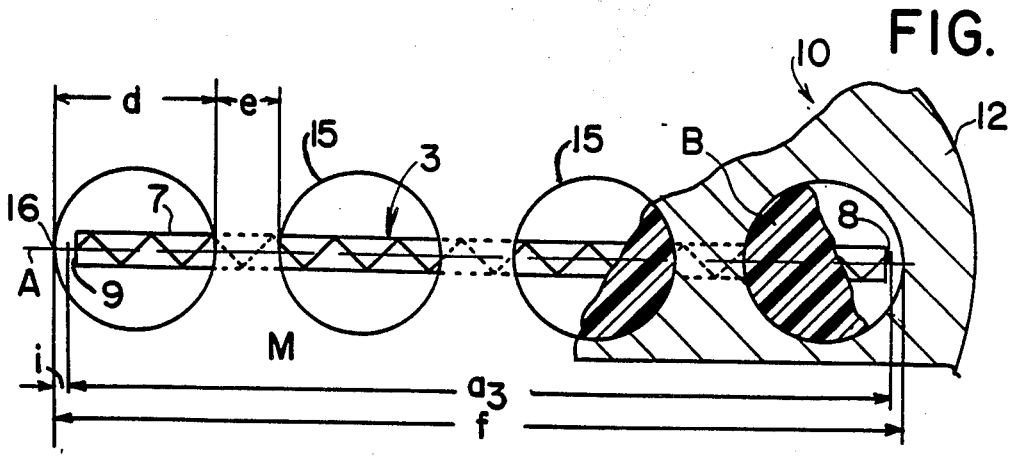
FIG. 2: Is an end view of a part of another version of container.

FIG. 2 shows a flat hollow section 3 of small height h, the breadth $a_3$ at 1200 mm is almost twice the breadth $a_2$ of hollow section 2 in FIG. 1. Hollow section 3 is made up of two parallel main walls 7, sidewalls 8 joining these, and struts 9.

Hollow section 3 is produced by extruding from billets B which are round in cross-section and are accommodated in the round bores 15 of container 10. The diameter d of the bores 15 is 250 mm, the distance e between them 100 mm so that the overall length f is 1300 mm. At both sides of section 3 there is a distance i of 50 mm between section side-wall 8 and saddle point 15 of the outermost bore 15.

In accordance with the preferred embodiment of the present invention the width of the plurality of container bores 15 of the container 10, that is the overall length, is substantially equal to or greater than the width of the wide rectangular hollow section being extruded. For example, in the preferred embodiment the overall width f of the container bores is about 1300 mm while the overal width of the extruded hollow section is about 1200 mm.

Upstream, in terms of extrusion direction x, of container 10, loaded with billets B in its four round bores 15 lying on a common axis A through center M, is a main stem 20 carrying four individual stems 21 with dummy blocks 22 pointing towards billets B in bores 15.

After the container 10, as viewed in the direction of extrusion x, is a die slide 25 with die 26 in the end plate 27 of which can be seen four groups of four inlet openings 30; each group of four openings 30 is arranged in a square pattern and is aligned with one of the bores 15 in the container 10. The die 26 is supported at the back by a die backer 24.

Figure 3:
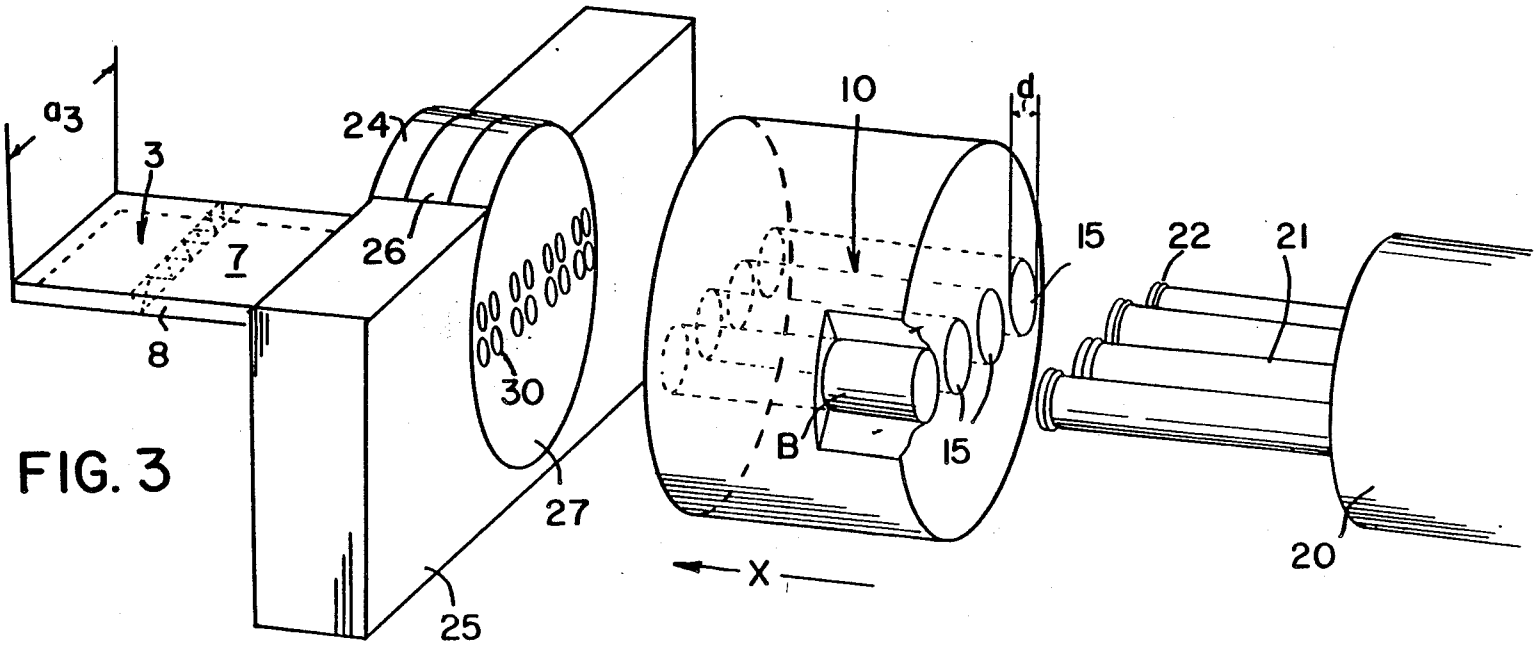
FIG. 3: Is a schematic representation of an extrusion press.

During the extrusion process, the light metal coming from the billet B under the extrusion force passes through the inlet openings 30 on end plate 27 into the shape-giving cross-section of the die, which is not shown in FIG. 3, and emerges from the die as the hollow section 3.

Figures 4, 5:
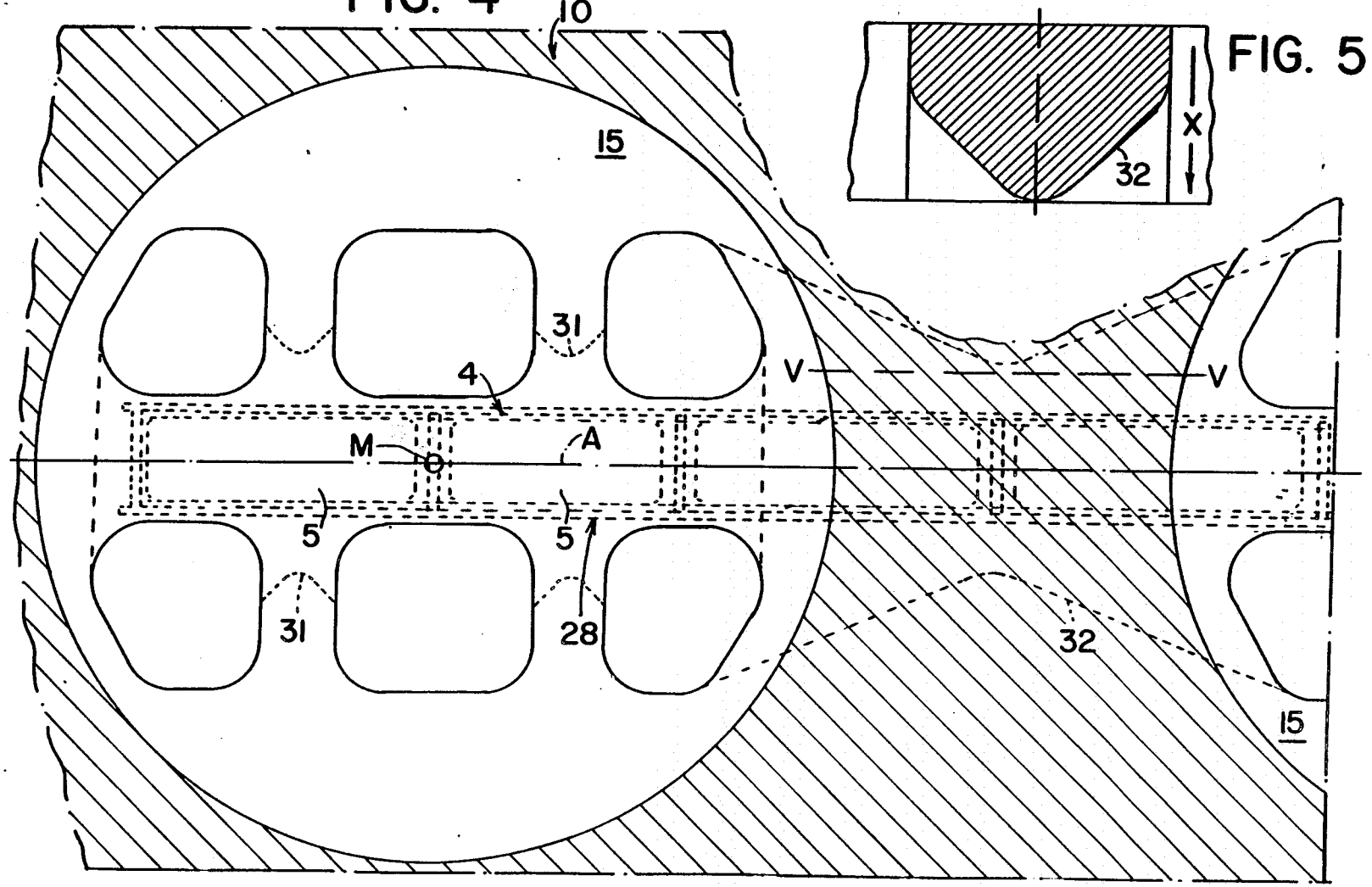
FIG. 4: Is an enlarged view of part of the extrusion press.
FIG. 5: Is a detail from FIG. 4 sectioned along line V—V.

FIG. 4 shows part of a container 10 with two of four round bores 15 and behind these the end plate 27 is the die 26 with shape-giving opening 28 for a multi-chamber section 4 with chambers 5 that are rectangular in cross-section.

Contours 31 are intended to illustrate the confluence of the metal to the resultant multi-chamber section 4; FIG. 5 indicates the tapering, in the direction of extrusion x, of the walls 32 of the die 26 between the round bores 15.

By way of example rectangular containers (dimensions 750×250 mm) such as shown in FIG. 1 permit a specific pressure of 480N/mm$^2$ to be developed on an 8500 Mp press. The resultant specific pressure of 440N/mm$^2$, obtained on replacing container 1 by a container 10 with four bores 15 of diameter d equal to 250 mm and at a spacing e of 100 mm, is fully sufficient to produce hollows sections out of aluminum alloys and increases the possible section breadth $a_3$ from 700 to 1200 mm.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A process for manufacturing a wide, rectangular hollow section extrusion from a plurality of metal billets comprising providing a container having a plurality of container bores in side-by-side relationship along a straight common line such that the combined width of said plurality of container bores is substantially equal to the width of said wide, rectangular hollow section, positioning a metal billet in each of said plurality of container bores, positioning a plurality of mandrels downstream of said container wherein each of said plurality of mandrels is associated with a container bore, positioning a rectangular extrusion die downstream of said container wherein the major axis of the die is parallel to said common line, providing a plurality of extrusion stems each of which is adapted to be received within one of said plurality of container bores for pressing said metal billet in each of said container bores via said plurality of mandrels through said die and simultaneously moving said plurality of extrusion stems so as to extrude said metal billet in each of said container bores through said die wherein the metal from said metal billet in each of said container bores is united to form a wide, rectangular hollow section.

2. A device for manufacturing a wide, rectangular hollow section extrusion from a plurality of metal billets which comprises a container, a plurality of bores in said container positioned in side-by-side relationship along a straight common line such that the combined width of said plurality of container bores is substantially equal to the width of said wide, rectangular hollow section, a plurality of mandrels downstream of said container wherein each of said mandrels is associated with a container bore, a main stem, a plurality of extrusion stems mounted on said main stem each of which is adapted to be received within one of said plurality of bores for pressing said metal billets in each of said bores via said plurality of mandrels, a rectangular die downstream of said bores in said container for receiving metal from metal billets positioned in said bores wherein the major axis of the die is parallel to said common axis and wherein said metal from said metal billet in said bores is united to form a wide, rectangular hollow section.

3. A device according to claim 2 wherein said straight common line is horizontal.

4. A device according to claim 2 wherein each of said plurality of extrusion stems includes a dummy block.

* * * * *